US009950326B2

(12) United States Patent
Katsuno et al.

(10) Patent No.: US 9,950,326 B2
(45) Date of Patent: Apr. 24, 2018

(54) COATING NOZZLE FOR HIGH-VISCOSITY PAINT

(71) Applicant: AISIN KAKO KABUSHIKI KAISHA, Toyota-shi (JP)

(72) Inventors: Tomoaki Katsuno, Toyota (JP); Toshimichi Hiraki, Toyota (JP)

(73) Assignee: AISIN KAKO KABUSHIKI KAISHA, Toyota-shi (JP)

( * ) Notice: Subject to any disclaimer, the term of this patent is extended or adjusted under 35 U.S.C. 154(b) by 334 days.

(21) Appl. No.: 14/155,743

(22) Filed: Jan. 15, 2014

(65) Prior Publication Data

US 2014/0231552 A1 Aug. 21, 2014

(30) Foreign Application Priority Data

Feb. 15, 2013 (JP) ..... 2013-027887

(51) Int. Cl.
*B05B 1/04* (2006.01)
*B05B 13/04* (2006.01)
*B05C 5/02* (2006.01)

(52) U.S. Cl.
CPC ..... *B05B 1/044* (2013.01); *B05B 13/0431* (2013.01); *B05C 5/0212* (2013.01); *B05C 5/0254* (2013.01)

(58) Field of Classification Search
CPC ..... B05B 1/04; B05B 1/044; B05B 13/0431; B05C 5/0212; B05C 5/0254
USPC ..... 239/597
See application file for complete search history.

(56) References Cited

U.S. PATENT DOCUMENTS 3,052,565 A * 9/1962 Chinn et al. ..... B05C 5/0212 118/211
4,416,214 A * 11/1983 Tanaka ..... B05C 5/0254 118/325
4,790,485 A * 12/1988 Yamamoto ..... B05B 1/044 239/515
4,830,882 A * 5/1989 Ichinose ..... B05B 15/0266 118/300
4,880,663 A * 11/1989 Shimada ..... B05B 1/04 427/207.1

(Continued)

FOREIGN PATENT DOCUMENTS

CA 2 803 777 A1 1/2012
JP 11-179243 7/1999

(Continued)

OTHER PUBLICATIONS

Office Action issued Feb. 19, 2015 in Canadian Patent Application No. 2,839,925.

(Continued)

*Primary Examiner* — Chee-Chong Lee
(74) *Attorney, Agent, or Firm* — Oblon, McClelland, Maier & Neustadt, L.L.P.

(57) ABSTRACT

A coating nozzle for high-viscosity paint includes a nozzle slit. The nozzle slit exhibits a specific reduced slit angle, and includes a nozzle-slit outlet, and a nozzle-slit inlet. The nozzle-slit outlet is formed as a distinct substantially-arced shape elongating lopsidedly from the nozzle-slit inlet to the nozzle-slit outlet. The coating nozzle including the nozzle slit can optimize a shear velocity of high-viscosity paint for a discharge rate of the high-viscosity paint in a setting of the actual employment.

6 Claims, 10 Drawing Sheets

(56) References Cited

U.S. PATENT DOCUMENTS

| | | | | |
|---|---|---|---|---|
| 5,009,933 | A * | 4/1991 | Matsuda | B05C 3/18 118/407 |
| 6,562,139 | B2 * | 5/2003 | Morton | B05B 12/00 118/44 |
| 2013/0119165 | A1 | 5/2013 | Tomita et al. | |

FOREIGN PATENT DOCUMENTS

| | | | | |
|---|---|---|---|---|
| JP | 2002273317 | * | 9/2002 | B05D 1/02 |
| JP | 2003311188 | * | 5/2003 | B05D 1/04 |
| JP | 2012-11284 | | 1/2012 | |

OTHER PUBLICATIONS

Office Action issued Jan. 8, 2016 in Canadian Patent Application No. 2,839,925.
Office Action issued in Canadian Patent Application No. 2,839,925 dated Oct. 27, 2016.

* cited by examiner

COATING NOZZLE FOR HIGH-VISCOSITY PAINT

INCORPORATION BY REFERENCE

The present invention is based on Japanese Patent Application No. 2013-027887, filed on Feb. 15, 2013, the entire contents of which are incorporated herein by reference.

BACKGROUND OF THE INVENTION

Field of the Invention

The present invention relates to a coating nozzle to be attached to the paint-discharge leading-end section of a coating apparatus for blowing a high-viscosity paint onto an object to be coated.

Description of the Related Art

Coating nozzles for blowing high-viscosity paints, such as acrylic-resin-based paints, polyester-resin-based paints, polyurethane-resin-based paints, epoxy-resin-based paints, or melamine-resin-based resins, onto objects to be coated have been known publicly. For example, in automobile manufacturing plants, high-viscosity paints have been blown onto automotive bodies in order to give them rust-preventive, waterproof and vibration-damping properties, with use of coating nozzles being installed on robots, as disclosed in Japanese Unexamined Patent Publication (KOKAI) Gazette No. 2012-11284 and Japanese Unexamined Patent Publication (KOKAI) Gazette No. 11-179243 (hereinafter, being referred to as "Related Art No. 1" and "Related Art No. 2," respectively).

FIGS. 6 and 7 illustrate a coating nozzle that Related Art No. 1 discloses. FIG. 6 shows a plan-view diagram of a coating nozzle 110. FIG. 7 shows a front-view diagram of the coating nozzle 110 when being viewed on a side of the paint-discharge leading end. The coating nozzle 110 comprises an introduction passage 117, an internal space 116, and a nozzle slit 115. The introduction passage 117, the internal space 116 and the nozzle slit 115 are communicated with each other, and are disposed in this order from the bottom to the top in FIG. 6. A high-viscosity paint, which has been supplied to the internal space 116 through the introduction passage 117, is reserved temporarily in the internal space 116 whose space spreads more than that of the introduction passage 117, and thereby the inner pressure is uniformized. Then, the high-viscosity paint, which has been extruded out from the internal space 116 to a nozzle-slit inlet 115G, is discharged from a nozzle-slit outlet 115E to an object to be coated while spreading radially to the object. As a result, the high-viscosity paint is coated as a strip shape with a predetermined patterned width on a surface of the object to be coated.

The nozzle slit 115 is formed as a strip shape with an arc configuration going along an arc in the coating nozzle 110 that is formed as a substantially-sectored shape when being viewed in the planar diagram. The intervening space between a nozzle-slit outlet 115E and the nozzle-slit inlet 115G is designed to have a uniform interval substantially. As illustrated in FIG. 7, the nozzle-slit outlet 115E has an opening configuration (or discharge-mouth configuration) that takes on a rectangular shape whose slit opening is "x" and slit width is "y." As illustrated in FIG. 6, the nozzle slit 115 converges linearly from the nozzle-slit outlet 115E to the nozzle-slit inlet 115G toward an imaginary apex "c" being held between the two equilateral sides of an imaginary isosceles triangle. Note that, in the imaginary isosceles triangle, the bottom side is made by an imaginary chord that connects linearly between an opposite end "e" of the nozzle-slit outlet 115E being formed as an arc shape and the other opposite end "f" thereof, and each of the bottom angles is made by an angle "α" (hereinafter, being referred to as a "slit angle 'α'"). That is, the nozzle-slit 115 spreads linearly from the imaginary apex "c" with an opening angle "β" (i.e., "β"=180°−2×"α").

When a distance between the imaginary apex "c" and the opposite end "e" (or the opposite end "f") is labeled a first radius "a," and another distance between the imaginary apex "c" and a central point "d" in the width-wise direction of the nozzle-slit outlet 115E is labeled a second radius "b," the first radius "a" and the second radius "b" are designed to be equal to each other (i.e., the first radius "a"=the second radius "b"). Thus, the nozzle-slit outlet 115E is formed as a true arc shape about the imaginary apex "c" serving as the center. Moreover, the high-viscosity paint is spouted substantially perpendicularly to an opening face of the nozzle-slit outlet 115E that takes on a true arc shape.

FIG. 8 is a graph for illustrating relationships between the discharge rates and shear velocities in the conventional coating nozzles that Related Art Nos. 1 and 2 disclose. When the shear velocity is labeled "D" ($s^{-1}$), the discharge rate is labeled "q" (c.c./minute), and the slit opening is labeled "x" (mm) that is shown in FIG. 7, and the slit opening area is labeled "s" ($mm^2$), the shear velocity "D" can be found by such a calculating equation as follows:

$$\text{"}D\text{"}=[\{\text{"}q\text{"}/60\}/\text{"}x\text{"}\}/\text{"}s\text{"}]\times 1{,}000.$$

Note that the slit opening area "s" can be found as a product "x"·"y" of the slit opening "x" and the slit width "y" because it is equivalent to the opening area of the nozzle-slit outlet 115E when being viewed in the planar diagram.

A line "L1" in FIG. 8 shows a relationship between the discharged rate "q" and the shear velocity "D" when the slit opening "x" was set at 0.4 mm (i.e., "x"=0.4 mm) and the slit width "y" was set at 39 mm in the conventional coating nozzle that Related Art No. 1 discloses. Moreover, a line "L2" in FIG. 8 shows a relationship between the discharged rate "q" and the shear velocity "D" when the slit opening "x" was set at 0.6 mm (i.e., "x"=0.6 mm) and the slit width "y" was set at 43 mm in the conventional coating nozzle that Related Art No. 2 discloses. In addition, a line "L3" in FIG. 8 shows a relationship between the discharged rate "q" and the shear velocity "D" when the slit opening "x" was set at 0.8 mm (i.e., "x"=0.8 mm) and the slit width "y" was set at 43 mm in the conventional coating nozzle that Related Art No. 2 discloses.

As one of the achievements of earnest studies by the present inventors, it was revealed that whether the coated appearance (e.g., flatness and/or smoothness) of a coated high-viscosity paint on an object to be coated is satisfactory or not is intimately related to the shear velocity "D" when the high-viscosity paint passes through the slit of a coating nozzle. Specifically, when the shear velocity "D" falls in a range of from 5,000 to 20,000 $s^{-1}$ roughly, the high-viscosity paint is likely to produce a satisfactory appearance. When the shear velocity "D" falls outside the range, however, undulating phenomena occur where the resulting coated form of a high-viscosity paint "P" undulates greatly as shown in FIG. 9. As a result, such a case might possibly arise where the resultant film thickness cannot be constant or uniform in the coated high-viscosity paint "P," because no flatness and/or smoothness can be secured in the coated high-viscosity paint "P."

In automobile manufacturing plants, a coating nozzle, which has been installed to a robot, is used to discharge the high-velocity paint "P" at such a flow rate that makes the discharge rate "q" fall in a range of from 3,000 to 10,000 c.c./minute roughly. The hatched area in FIG. 8 shows an area where the shear velocity "D" becomes from 5,000 to 20,000 $s^{-1}$ when the discharge rate "q" falls in a range of from 3,000 to 10,000 c.c./minute in a setting of the actual employment. Therefore, when the shear velocity "D" is contained within the hatched area in FIG. 8, like the ideal line "L0" in the drawing, in a range where the discharge rate "q" falls in a range of from 3,000 to 10,000 c.c./minute in a setting of the actual employment, it is effective to reduce the occurrence of faulty painted appearances when a coating nozzle is used actually.

As the lines "L1," "L2," and "L3" in FIG. 8 indicate, however, the related-art coating nozzles might possibly result in such cases that they yield the shear velocity "D" that falls outside the hatched area in a setting of the actual employment where the discharge rate "q" falls in a range of from 3,000 to 10,000 c.c./minute. Therefore, the related-art coating nozzles have not been designed so as to be capable of reducing the occurrence of faulty coated appearances in a setting of the actual employment. Hence, the related-art coating nozzles might possibly have been associated with the following fears: quality problems in which the coated high-viscosity paint "P" interferes with other component parts because the undulating phenomena have thickened the resulting film thickness depending on the discharge rate "q" of the high-viscosity paint "P"; and problems causing the increment of painting costs because the high-viscosity paint "P" has been coated in excessive amounts, which are more than those being directed in engineering drawings, to result in the occurrence of material wastes.

Moreover, in a case where the related-art coating nozzles are simply provided with a smaller slit opening "x" so as to enlarge the shear velocity "D" in order to reduce the occurrence of faulty coated appearances, they might possibly be associated with a fear of the occurrence of clogging in the nozzle slit when it might not be possible to fully inhibit foreign materials from remaining or residing within the high-viscosity paint "P." In addition, in another case where the related-art coating nozzles are provided with the above-described slit angle "α" which has been made smaller so as to enlarge the diffusion of the high-viscosity paint "P" in the width-wise direction, in order to secure a predetermined patterned width, they might possibly be associated with another fear of the occurrence of cracked patterns as shown in FIG. 10.

SUMMARY OF THE INVENTION

The present invention has been developed in view of the circumstances being mentioned above. It is therefore an object of the present invention to provide a novel coating nozzle for high-viscosity paint. That is, a coating nozzle according to the present invention not only makes it possible to coat high-viscosity paints to coated appearances that are smooth and/or flat satisfactorily, and which are thin-filmed and have proper patterned widths; but also comprises a nozzle slit that is less likely to be clogged.

For example, in accordance with a first subject matter according to the present invention, a coating nozzle for high-viscosity paint can achieve the aforementioned object, and comprises:

an introduction passage, an internal space, and a nozzle slit that communicate with each other and are disposed in this order so as to supply a high-viscosity paint to the internal space through the introduction passage, and so as to reserve the high-viscosity paint temporarily in the internal space, the high-viscosity paint being discharged from the nozzle slit while spreading radially, and then being blown onto an object to be coated;

the nozzle slit including a nozzle-slit inlet on the internal space and a nozzle-slit outlet on a paint-discharge leading-end side, and being formed as a substantially-sector-shaped trapezoid that has a dimension expanding from the nozzle-slit inlet to the nozzle-slit outlet in a width-wise direction;

the nozzle-slit outlet being formed as an arc shape that has opposite ends and an imaginary chord connecting the opposite ends one another linearly;

the nozzle slit having a slit width that is made of the imaginary chord, and converging from the nozzle-slit outlet side to the nozzle-slit inlet side while heading toward an imaginary apex being held between two equilateral sides of an imaginary isosceles triangle whose base is the imaginary chord and whose base angles are a predetermined slit angle being less than 45 degrees;

the arc-shaped nozzle-slit outlet exhibiting a radius ratio that is a value being obtained by dividing a second radius by a first radius, and which is greater than 1 when a first distance between the imaginary apex of the imaginary isosceles triangle and each of the opposite ends of the imaginary chord is labeled the first radius and a second distance between the imaginary apex of the imaginary isosceles triangle and a central point in a width-wise direction of the arc-shaped nozzle-slit outlet is labeled the second radius; and the nozzle-slit outlet having, when being viewed on the paint-discharge leading-end side, a slit opening area that makes a shear velocity of the high-viscosity paint, which passes through the nozzle-slit outlet, fall in a range of from 5,000 to 20,000 $s^{-1}$ for a discharge rate of from 3,000 to 10,000 c.c./minute of the high-viscosity paint.

Moreover, in accordance with a second subject matter according to the present invention, the present coating nozzle according to the first subject matter can comprise the nozzle slit whose slit angle falls in a range of from 35 to 42.5 degrees.

In addition, in accordance with a third subject matter according to the present invention, the present coating nozzle according to the first subject matter can comprise the nozzle slit including the nozzle-slit outlet that exhibits the radius ratio falling in a range of from 1.03 to 1.11.

Since the present coating nozzle according to the first subject matter comprises the nozzle slit including the nozzle-slit outlet that makes a shear velocity of the high-viscosity paint, which passes through the nozzle-slit outlet, fall in a range of from 5,000 to 20,000 $s^{-1}$, the high-viscosity paint being coated on the object to be coated is likely to turn into thin-filmed coated appearance that are flat and/or smooth satisfactorily.

Note that, in the present specification, the term, "high-viscosity paint," refers to high-viscosity paints whose viscosity is 0.1 Pa·s or more at 20° C. Moreover, it is possible to find a shear velocity of the high-viscosity paint by the following calculating equation:

$$\text{“}D\text{”}=[\{\text{“}q\text{”}/60\}/\text{“}x\text{”}\}/\text{“}s\text{”}]\times 1{,}000;$$

when a shear velocity of the high-viscosity paint is labeled "D" ($s^{-1}$); a discharge rate of the high-viscosity paint is labeled "q" (c.c./minute); a slit opening of the nozzle-slit outlet is labeled "x" (mm); and a slit opening area of the nozzle-slit outlet is labeled "s" ($mm^2$). Note that, when the nozzle-slit outlet has an opening whose configuration is a rectangular shape, it is possible to find the slit opening area "s" as a product "x"·"y" of the slit opening "x" and a slit width "y" of the nozzle-slit outlet because the slit opening area "s" is equivalent to the opening area of the nozzle-slit outlet when being viewed in the planar diagram.

Moreover, in the present specification, the term, "substantially-sector-shaped trapezoid," refers to trapezoidal shapes in which an arc with a smaller curvature radius substitutes for the shorter top side of an ordinary trapezoid and another arc with a larger curvature radius substitutes for the longer bottom side. In addition, the term, "arc," involves all curves in which, of protruded curves such as elliptical curves, hyperbolic curves and parabolic curves, a radius ratio, a quotient that results from the division of the second radius by the first radius, is greater than 1.

In addition, the present coating nozzle according to the first subject matter comprises the nozzle slit including the nozzle-slit outlet with a smaller slit opening area in order to make a shear velocity of the high-viscosity paint fall in the above-described proper range. Note that the slit opening area according to the present coating nozzle is smaller than that of the nozzle-slit opening according the related-art coating nozzles even when the two have an identical slit outlet to each other. That is, the nozzle-slit outlet has a slit width that is set up to be smaller. In other words, in order to make a shear velocity of the high-viscosity paint larger, the slit opening area according to the present coating nozzle is made smaller, not by making the slit opening smaller, but by making the slit width smaller. Therefore, the nozzle slit according to the present coating nozzle is less likely to be clogged even when foreign materials cannot be fully inhibited from remaining or residing within the high-viscosity paint.

Moreover, setting up the slit width smaller as described above makes the high-viscosity paint less likely to secure a predetermined patterned width. However, the present coating nozzle according to the first subject matter comprises the nozzle slit whose slit angle is set up to be smaller, at less than 45 degrees, for instance. The nozzle slit with such a slit angle makes the high-viscosity paint, which is discharged from the nozzle-slit outlet, diffuse in the width-wise direction to a greater extent. By simply making the slit angle smaller, however, it is difficult to provide the high-viscosity paint with a predetermined patterned width while preventing the resulting pattern from cracking.

Hence, the present coating nozzle according to the first subject matter comprises the nozzle slit including the nozzle-slit outlet that has an arc configuration being set up so that a radius ratio, a quotient that results from the division of the second radius at the middle in the nozzle-slit outlet by the first radius at the opposite ends in the nozzle-slit outlet, is greater than 1. That is, the nozzle-slit outlet according to the first subject matter has an arc configuration that elongates lopsidedly (or that is prolate) in a direction toward the middle. Since the high-viscosity paint is spouted substantially perpendicularly to the nozzle-slit outlet's opening face that takes on an arc configuration, the nozzle-slit outlet whose arc configuration elongates lopsidedly (or whose arc configuration is prolate) in a direction toward the middle makes it possible to enlarge an extent of the diffusion of the high-viscosity paint, which is discharged from the nozzle-slit outlet, in the width-wise direction. Consequently, setting up the slit angle to be smaller, at less than 45 degrees, for instance, and elongating the nozzle-slit outlet's arc configuration lopsidedly (making the nozzle-silt outlet's configuration prolate) in a direct ion toward the middle, produce the following synergetic effect: not only making the diffusion of the high-viscosity paint greater in the width-wise direction while preventing the resulting pattern from cracking; but also enabling the high-viscosity paint to secure a predetermined patterned width for the resultant pattern.

Since the present coating nozzle according to the second subject matter comprises the nozzle slit whose nozzle-slit outlet exhibits the slit angle being set to fall in a range of from 35 to 42.5 degrees, the advantage of securely providing the resulting pattern with a predetermined patterned width can be effected with higher reliability without ever causing cracks to occur in the resultant pattern that is made by the high-viscosity paint being coated on an object to be coated. Note that, when the slit angle is less than 35 degrees, the resulting pattern is likely to be cracked because the extent of the diffusion of the high-viscosity paint becomes too great in the width-wise direction. On the other hand, when the slit angle exceeds 42.5 degrees, the resultant pattern is likely to be deficient in the patterned width because the extent of the diffusion of the high-viscosity paint becomes too small in the width-wise direction.

Since the present coating nozzle according to the third subject matter comprises nozzle slit whose nozzle-slit outlet exhibits the radius ratio being set to fall in a range of from 1.03 to 1.11, the advantage of securely providing the resulting pattern with a predetermined patterned width can be effected with higher reliability without ever causing cracks to occur in the resultant pattern that is made by the high-viscosity paint being coated on an object to be coated. Note that, when the radius ratio is less than 1.03, the resulting pattern is likely to be deficient in the patterned width because the extent of the diffusion of the high-viscosity paint becomes too small in the width-wise direction. On the other hand, when the radius ratio exceeds 1.11, the resultant pattern is likely to be cracked because the extent of the diffusion of the high-viscosity paint becomes too great in the width-wise direction.

As described above, the present invention makes it possible to provide a novel coating nozzle for high-viscosity paint, the coating nozzle not only enabling manufacturers to coat high-viscosity paints to thin-filmed coated appearances that are smooth and/or flat satisfactorily, and to coat high-viscosity paints with thin-filmed and proper patterned widths; but also comprising a nozzle slit that is less likely to be clogged.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure.

DETAILED DESCRIPTION OF THE PREFERRED EMBODIMENTS

Having generally described the present invention, a further understanding can be obtained by reference to the specific preferred embodiments which are provided herein for the purpose of illustration only and not intended to limit the scope of the appended claims.

Figure 1:
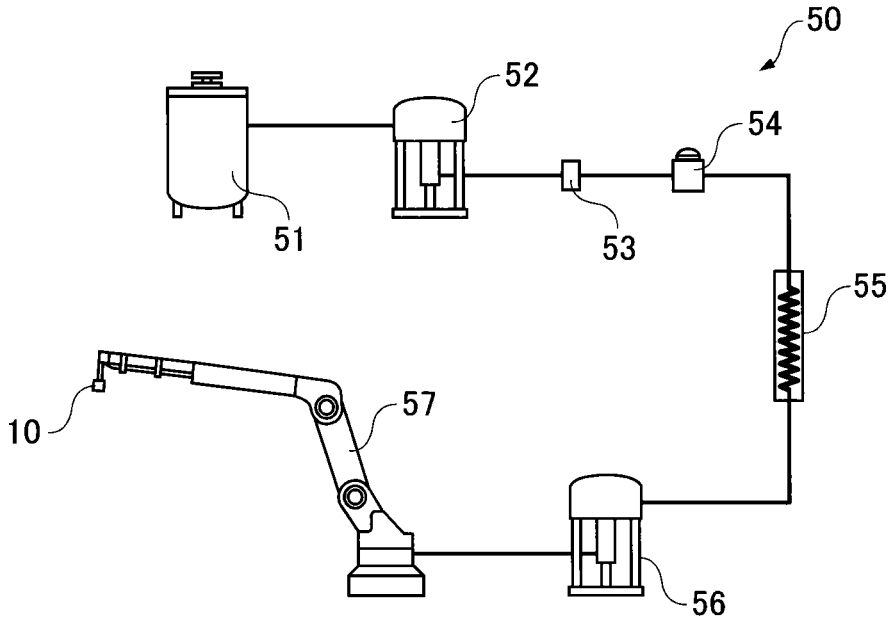
FIG. 1 is a constructional diagram for illustrating the entire construction of a coating facility being equipped with a coating nozzle according to an embodiment of the present invention.
Figure 2:
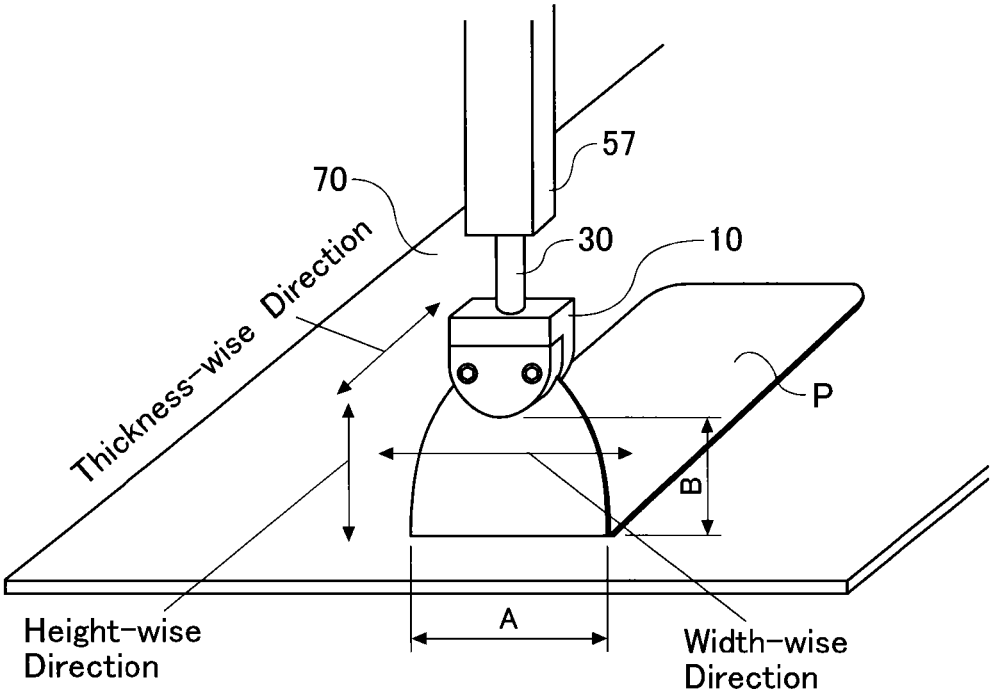
FIG. 2 is a perspective diagram for illustrating the entire construction of the coating nozzle according to the present embodiment.

With reference to FIGS. 1 through 5, a coating nozzle for high-viscosity paint according to an embodiment of the present invention will be hereinafter described in more detail. As illustrated in FIGS. 1 and 2, a coating facility 50 being equipped with a coating nozzle 10 is a system to be installed in an automobile manufacturing plant, and makes a facility for blowing a high-viscosity paint "P" quantitatively onto an automotive body 70 (i.e., an object to be coated). The coating facility 50 comprises a material container 51, a plunger pump 52, a filter 53, a regulator 54, a heat exchanger 55, a metering pump 56, a robot arm 57, and the coating nozzle 10. Note that the following can be used for the high-viscosity paint "P" that the coating facility 50 spouts: acrylic-resin-based paints, polyester-resin-based paints, polyurethane-resin-based paints, epoxy-resin-based paints, or melamine-resin-based resins.

The material container 51 reserves the high-viscosity paint "P" therein. The plunger pump 52 fills up the high-viscosity paint "P" in the entire painting facility 50, and pressure delivers it therearound. The filter 53 removes foreign materials having been mingled accidentally in the high-viscosity paint "P." The regulator 54 keeps pressures of the high-viscosity paint "P" appropriately within the painting facility 50. The heat exchanger 55 keeps the high-viscosity paint "P" at a constant temperature within the painting facility 50. Note that the high-viscosity paint "P" is kept at 25° C. in the present embodiment, for instance. The metering pump 56 is driven by a not-shown servomotor, and adjusts a discharge rate of the high-viscosity paint "P" onto the coating nozzle 10. The robot arm 57 moves the coating nozzle 10 freely with respect to the automotive body 70.

As illustrated in FIG. 2, the coating nozzle 10 spouts the high-viscosity paint "P," which is supplied through an introduction tube 30, toward one of the surfaces of the automotive body 70 while spreading the high-viscosity paint "P" radially in the width-wise direction and turning it into a film with a constant thickness in the thickness-wise direction. According to a coating method for the high-viscosity paint "P" with use of the coating nozzle 10, the high-viscosity paint "P" is discharged from the coating nozzle 10 during which the coating nozzle 10 is kept at a predetermined distance "B" from the surface of the automotive body 70 in the height-wise direction while being moved parallel in the thickness-wise direction slowly. Then, the high-viscosity paint "P," which is discharged from the coating nozzle 10, is adhered onto the surface of the automotive body 70, and the high-viscosity paint "P" is thereby coated to a predetermined patterned width "A" on the surface of the automotive body 70. On this occasion, it is possible for the coating facility 50 to carry out the coating while changing the patterned width "A," the coated film thickness, and so on, because the coating facility 50 moves the robot arm 57 freely with respect to the automotive body 70 to control the distance "B" between the coating nozzle 10 and the surface of the automotive body 70, and to control the relative coating position of the coating nozzle 10 with respect to the surface of the automotive body 70.

Figure 3:
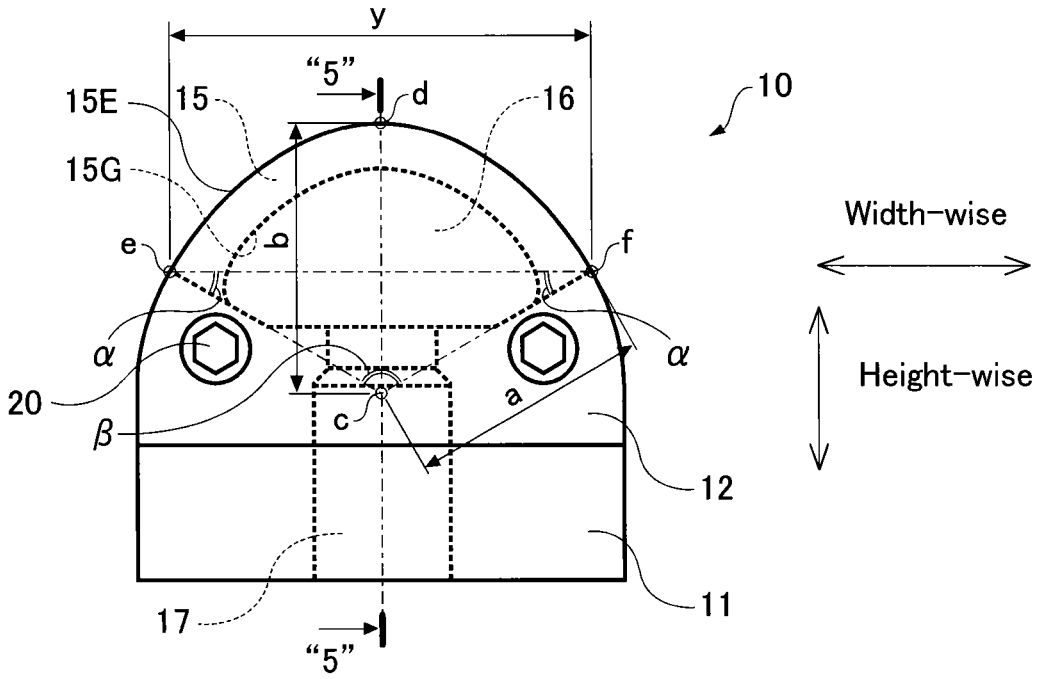
FIG. 3 is a plan-view diagram for illustrating the coating nozzle according to the present embodiment.
Figure 4:
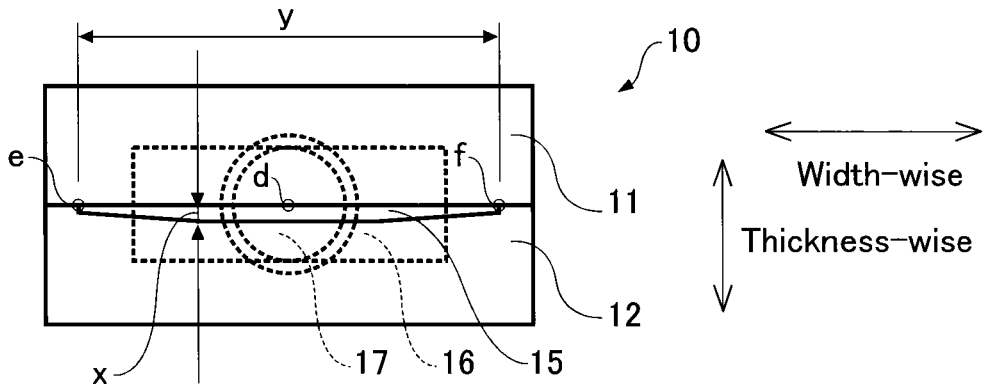
FIG. 4 is a front-view diagram for illustrating the coating nozzle according to the present embodiment.
Figure 5:
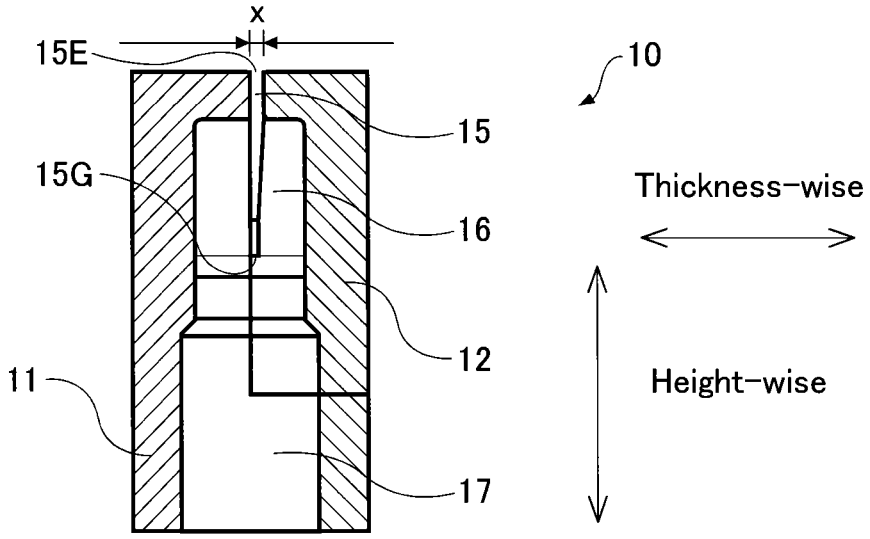
FIG. 5 is a cross-sectional diagram for illustrating the coating nozzle according to the present embodiment that is cut along the line "5"-"5" in FIG. 3.
Figure 6:
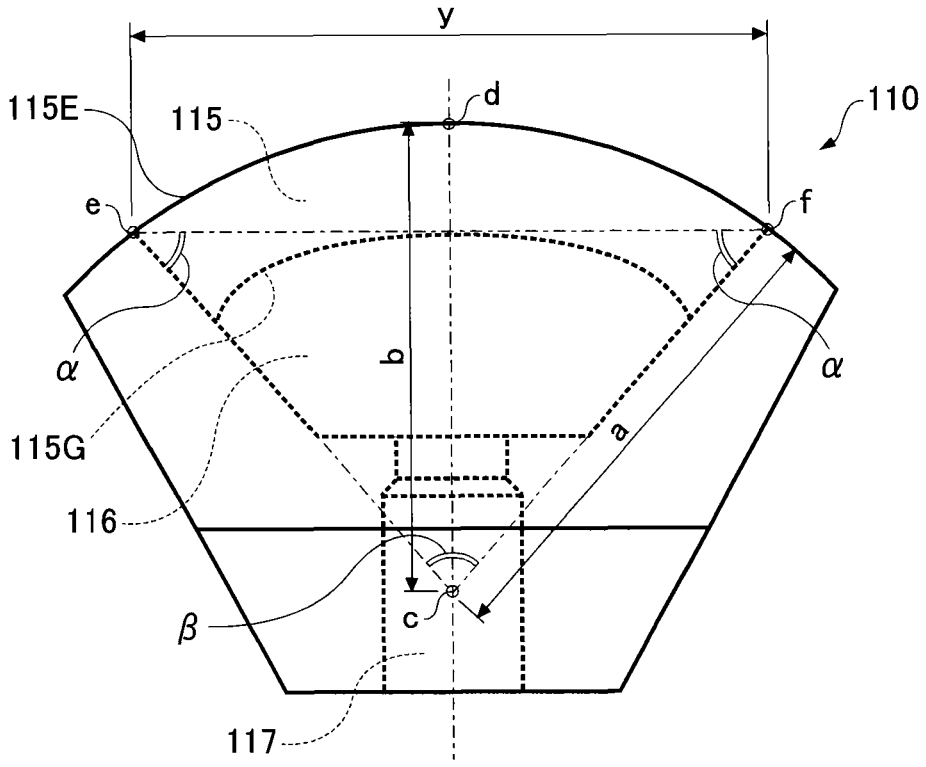
Fig. 6 (Related Art)
FIG. 6 is a plan-view diagram for illustrating a conventional coating nozzle that Related Art No. 1 discloses.
Figure 7:
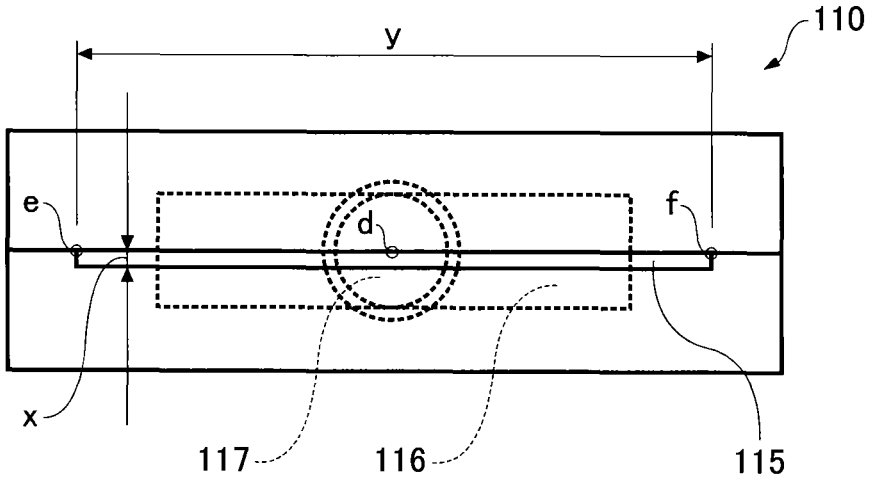
Fig. 7 (Related Art)
FIG. 7 is a front-view diagram for illustrating the conventional coating nozzle that Related Art No. 1 discloses.
Figure 8:
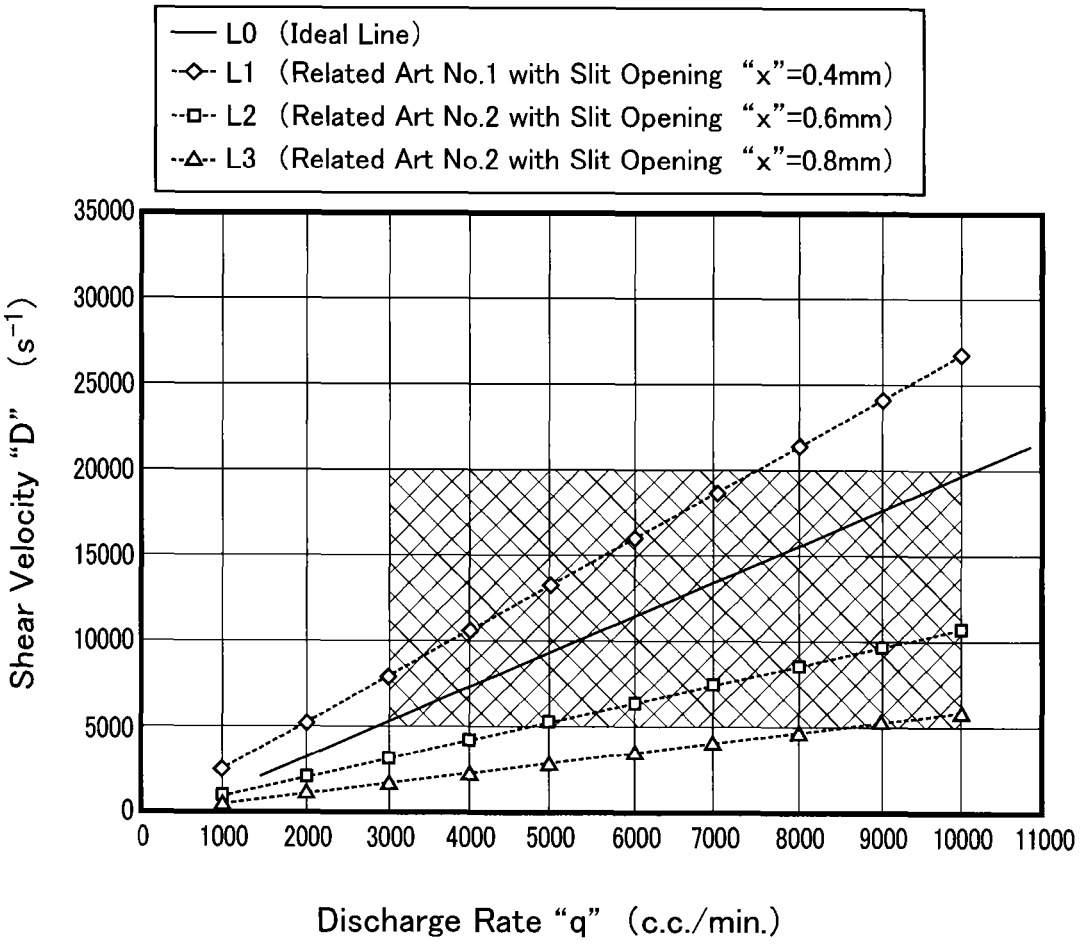
FIG. 8 is a graph for showing relationships between the discharge rates of high-viscosity paint and the shear velocities exhibited by conventional coating nozzles that Related Art Nos. 1 and 2 disclose.
Figure 9:
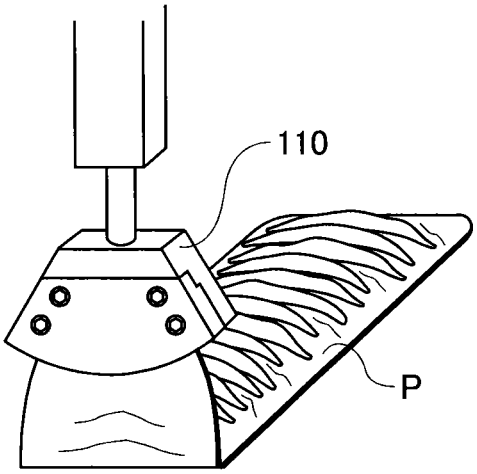
Fig. 9 (Related Art)
FIG. 9 is a perspective diagram for illustrating a faulty coated appearance that a current coating nozzle yielded, and in which the undulating phenomena arose under the circumstance.
Figure 10:
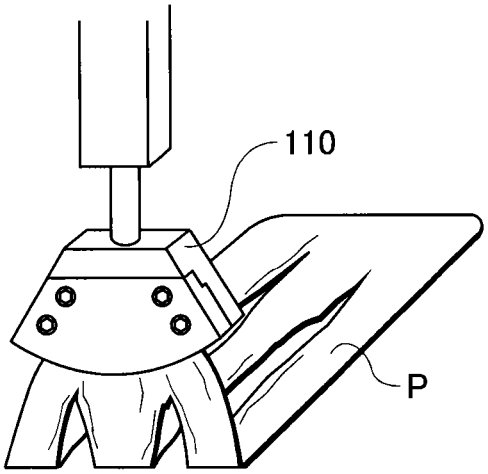
Fig. 10 (Related Art)
FIG. 10 is a perspective diagram for illustrating another faulty coated appearance that a current coating nozzle yielded, and in which the cracks occurred in the resulting pattern under the circumstance.

With reference to FIGS. 3 through 5, the coating nozzle 10 will be described in more detail how it is constructed. FIG. 3 shows the coating nozzle 10 in the plan-view diagram. FIG. 4 shows the coating nozzle 10 in the front-view diagram when being viewed on the paint-discharge leading-end side. FIG. 5 shows the coating nozzle 10 in the cross-sectional diagram when being cut along the line "5"-"5" in FIG. 3. The coating nozzle 10 comprises a body 11, and a lid 12. The coating nozzle 10 takes on a bell shape in which a substantially-half-moon and a rectangle are combined when being viewed in the planar diagram, and takes on a rectangular thick-plated shape when being viewed in the frontal and lateral diagrams. As illustrated in FIG. 5, the body 11 is formed as a letter-L shape, which is thicker on the rectangle side and thinner on the substantially-half-moon side, when being viewed in the lateral diagram. The lid 12 is formed as a flat plate that compensates for the thinner section on the substantially-half-moon side of the body 11. That is, the lid 12 is attached onto the body 11 at the thinner section on the substantially-half-moon side. Thus, the body 11, and the lid 12 make up the coating nozzle 10 having a thick-plated shape as a whole. Moreover, the body 11, and the lid 2 are fixated one another with two embedded screws 20.

As illustrated in FIG. 5, the coating nozzle 10 comprises a nozzle slit 15, an internal space 16, and an introduction passage 17. As illustrated in FIG. 3, the introduction passage 17, the internal space 16 and the nozzle slit 15, with which the coating nozzle 10 is provided, are disposed in this order from the bell-shaped rectangular side to the substantially-half-moon side in the coating nozzle 10 in the drawing. Moreover, the introduction passage 17, the internal space 16 and the nozzle slit 15 are formed so as to communicate with each other in the coating nozzle 10.

The nozzle slit 15 is formed as an arc-shaped strip that is disposed, when being viewed in the plan-view diagram, along the half-moon-shaped arc of the substantially-bell-shaped coating nozzle 10, as shown in FIG. 3. More precisely, the body 11 closes an arc-shaped and strip-like-dented opening face, with which the lid 12 of the coating nozzle 10 is provided, to form the nozzle slit 15, as shown in FIG. 5. The nozzle slit 15 makes a slit comprising a nozzle-slit outlet 15E, which is positioned on one of the opposite sides for discharging the high-viscosity paint "P," and a nozzle-slit inlet 15G, which is positioned on the other one of the opposite sides neighboring the internal space 16. The nozzle-slit outlet 15E, and the nozzle-slit inlet 15G are separated from one another with a substantially uniform interval. Note herein that the term, "arc," involves, among protruded curves such as elliptical arcs, hyperbolic curves and parabolic curves, all curves exhibiting a later-described radius ratio, a quotient "b/a" resulting from the division of the maximum radius "b" (i.e., a second radius) by the minimum radius "a" (i.e., a first radius), that is greater than 1. Moreover, the nozzle slit 15 according to the present embodiment includes the nozzle-slit outlet 15E having an arc shape that is turned into an elliptical arc.

The nozzle slit 15 has a substantially-sectored trapezoidal shape whose width-wise dimension expands from one of the opposite sides on the nozzle-slit inlet 15G to the other one of the opposite sides on the nozzle-slit outlet 15E. Note herein that the term, "substantially-sectored trapezoidal shape," refers to trapezoidal shapes in which an arc with a smaller curvature radius substitutes for the shorter top side of an ordinary trapezoids and another arc with a larger curvature radius substitutes for the longer bottom side. The nozzle-slit inlet 15G is a section that corresponds to an arc with a smaller curvature radius (i.e., the top side) in the substantially-sectored trapezoidal shape. The nozzle-slit outlet 15E is another section that corresponds to another arc with a larger curvature radius (i.e., the bottom side) in the substantially-sectored trapezoidal shape.

As illustrated in FIG. 4, the nozzle-slit outlet 15E has an opening configuration (or a discharge-mouth configuration) whose slit opening is set at "x" in the vicinity of the central point "d" in the width-wise direction, and whose slit width is set at "y," when being viewed in the front-view diagram. The nozzle-slit outlet 15E exhibits the slit opening "x" in a range that accounts for approximately ⅓ of the slit width "y" in the middle. Note that the nozzle-slit outlet 15E can preferably exhibit the slit opening width "x" in a range of approximately from ⅓ of the slit width "y" in the middle and up to 1 with respect to the slit width "y" in the entirety (that is, the slit opening width "x" can be kept constant in the thickness-wise direction over the entire slit width "y"). Moreover, the nozzle-slit outlet 15E further exhibits minor opposite slit openings that narrow down gradually from the opposite ends of the range toward the opposite ends "e" and "f" in the width-wise direction. The nozzle-slit opening 15 having the thus designed opening configuration thins out the high-viscosity paint "P," which is coated onto the automotive body 70, in the film thickness at around the opposite ends of the patterned width "A" in the width-wise direction. However, it is possible to coat the high-viscosity paint "P" evenly in the film thickness as a whole by overlapping or recoating the high-viscosity paint "P" one after another.

Note that the slit opening "x" is the maximum opening dimension of the nozzle-slit outlet 15E in the thickness-wise direction of the coating nozzle 10, and that the slit opening "x" is set up at 0.6 mm or more in the present embodiment. The slit width "y" is an opening dimension of the nozzle-slit outlet 15E in the width-wise direction of the coating nozzle 10. That is, the slit width "y" is a dimension of the section that makes an imaginary cord of an arc (i.e., an imaginary line connecting between the opposite end "e" and the opposite end "f") in the arc-shaped nozzle-slit outlet 15E when being viewed in the front-view diagram.

The nozzle slit 15 converges linearly from the side of the nozzle-slit outlet 15E toward the side of the nozzle-slit inlet 15G. Specifically, the nozzle slit 15 tapers linearly from wide to narrow as it heads toward an imaginary apex "c" being held between two equilateral sides of an imaginary isosceles triangle whose base is the imaginary chord and whose base angles are "α" (hereinafter, being referred to as a "slit angle 'α'"). Note that the imaginary chord connects linearly between the opposite end "e" and the opposite end "f" of the nozzle-slit outlet 15E being formed as an arc shape, as described above. In other words, the nozzle slit 15 spreads from the imaginary apex "c" with an opening angle "β" (i.e., "β"=180°−2×"α").

The coating nozzle 10 according to the present embodiment comprises the nozzle slit 15 exhibiting a slit angle "α" that is set up to fall in a range of from 35 to 42.5 degrees being involved in the claimed value of less than 45 degrees. Accordingly, the nozzle slit 15 exhibits an opening angle "β" being larger than 90 degrees, namely, the coating nozzle 10 according to the present embodiment comprises the nozzle slit 15 exhibiting an opening angle "β" that falls in a range of from 95 to 110 degrees. Moreover, the distance between the imaginary apex "c" and the opposite end "e" (or the opposite end "f") is the claimed "first radius" and makes the minimum radius "a" in the nozzle-slit outlet 15E; whereas the distance between the imaginary apex "c" and the central point "d" is the claimed "second radius" and makes the maximum radius "b" in the nozzle-slit outlet 15E. The coating nozzle according to the present embodiment comprises the nozzle-slit outlet 15E exhibiting a radius ratio "b/a," a ratio of the maximum radius "b" to the minimum radius "a", that is set up to fall in a range of from 1.03 to 1.11. Descriptions will be made hereinafter on reasons why the radius ratio is thus set up.

Setting up the distance between the imaginary apex "c" and the opposite end "e" and the distance between the imaginary apex "c" and the central point "d" differently from each other makes the nozzle slit 15 exert different resistances to the high-viscosity paint "P," which is discharged from the opposite end "e," and to the high-viscosity paint "P," which is discharged from the central point "d," when the high-viscosity paint "P" is discharged from the nozzle slit 15. Note herein that making the distance between the imaginary apex "c" and the opposite end "e" smaller than the distance between the imaginary apex "c" and the central point "d" leads to making the high-viscosity paint "P" likely to be discharged further away because the resistance at the opposite end "e" becomes smaller by the extent that the former distance becomes smaller than the latter distance. Consequently, it becomes likely to secure the patterned width "A," compared with the setup in which the distance between the imaginary apex "c" and the opposite end "e" and the distance between the imaginary apex "c" and the central point "d" are made equal to each other.

Because of the above, the lower-limit value, 1.03, is set up for the ratio (i.e., the radius ratio "b/a") of the distance from the imaginary apex "c" to the central point "d" (i.e., the maximum radius "b") to the distance from the imaginary apex "c" to the opposite end "e" or "f" (i.e., the minimum radius "a"). On the other hand, when the radius ratio "b/a" goes beyond 1.11, the nozzle slit 15 gives larger resistances to the high-viscosity paint "P" because the distance from the imaginary apex "c" to the central point "d" (i.e., the maximum radius "b") has become too long. As a result, cracks are likely to occur in the resulting pattern. Consequently, the radius ratio "b/a" is set up to fall in a range of from 1.03 to 1.11.

Moreover, the coating nozzle 10 according to the present embodiment comprises the nozzle slit 15 including the nozzle-slit outlet 15E that exhibits a distinct slit opening area being set up to make a shear velocity of the high-viscosity paint "P," which falls in a specific range (i.e., a conditional range where no faulty painted appearances arise), appropriate for a discharge rate of the high-viscosity paint "P," which falls in another specific range (i.e., a range of the discharge rate in a setting of the actual employment). Specifically, the nozzle slit 15 has a slit opening area "s"

(i.e., an opening area of the nozzle-slit outlet 15E when being viewed in the front-view diagram) that is set up to make a shear velocity "D" of the high-viscosity paint "P" passing through the nozzle-slit outlet 15E, which falls in a range of from 5,000 to 20,000 $s^{-1}$, appropriate for a discharge rate "q" of the high-viscosity paint "P" that falls in a range of from 3,000 to 10,000 c.c./minute. In addition, an opening configuration of the nozzle-slit outlet 15E, and the slit width "y" are set up so as to satisfy the requirement for the slit opening area "s." Note that it is possible to find the shear velocity "D" by following Equation (1):

$$\text{"}D\text{"}=[\{\text{"}q\text{"}/60\}/\text{"}x\text{"}\}/\text{"}s\text{"}]\times 1{,}000 \qquad \text{Equation (1)}$$

where "D" stands for a shear velocity ($s^{-1}$); "q" stands for a discharge rate (c.c./minute); "x" stands for a slit opening (mm); and "s" stands for a slit opening area ($mm^2$).

The coating nozzle 10 takes on a bell configuration substantially in which a substantially-half-moon shape and a rectangular shape are combined when being viewed in the front-view diagram. At around the middle in the substantially-half-moon-shaped section of the coating nozzle 10, the internal space 16 is formed, and is a space that takes on a substantially-half-moon shape, as shown in FIG. 3. Moreover, the internal space 16 is made up of a depression, with which the body 11 of the coating nozzle 10 is provided, and another depression, with which the lid 12 is provided, as shown in FIG. 5. In the internal space 16 that is formed as a substantially-half-moon shape, an arc-shaped section in the substantially-half-moon shape corresponds to one of the opposite ends of the nozzle slit 15. In addition, the internal space 16 is designed to have a dimension that is sufficiently larger than the slit opening "x" in the thickness-wise direction of the coating nozzle 10, as can be seen from FIG. 5.

As illustrated in FIG. 3, the introduction passage 17 is formed at the middle in the width-wise direction of the rectangle-shaped section in the coating nozzle 10 that takes on a bell shape substantially, in which a substantially-half-moon shape and a rectangular shape are combined, when being viewed in the front-view diagram. The introduction passage 17 is made up of depressions with which the body 11 and lid 12 of the coating nozzle 10 are provided, respectively, as shown in FIG. 5. The introduction passage 17 is formed as a cylindrical shape substantially that is continuous from the introduction pipe 30 shown in FIG. 2.

The high-viscosity paint "P," which is supplied to the internal space 16 through the introduction passage 17, exhibits a uniformized inner pressure, because it is reserved temporarily in the internal space 16 whose space is expanded more than that of the introduction passage 17. Thus, the high-viscosity paint "P" is supplied uniformly to the nozzle-slit inlet 15G of the nozzle slit 15. Then, the high-viscosity paint "P," which extruded out to the nozzle-slit inlet 15G from the internal space 16, is discharged from the nozzle-slit outlet 15E toward the automotive body 70, an object to be coated, while spreading radially.

The coating nozzle 10 according to the thus constructed present embodiment comprises the nozzle slit 15 including the nozzle-slit outlet 15E whose slit opening "x" is set at 0.6 mm or more at the central point "d" in the width-wise direction. Accordingly, the present coating nozzle 10 is less likely to be associated with such a fear that it is clogged by some of foreign materials that might possibly have remained or resided in the high-viscosity paint "P" even after they are removed by the filter 55. Moreover, the nozzle-slit outlet 15E, which the nozzle slit 15 includes, exhibits a slit opening area "s" that is set up so as to make a shear velocity "D" of the high-viscosity paint "P," which passes through the nozzle-slit outlet 15E, fall in a range of from 5,000 to 20,000 $s^{-1}$ for a discharge rate "q" of from 3,000 to 10,000 c.c./minute for the high-viscosity paint "P" in a setting of the actual employment. Consequently, the present coating nozzle 10 can readily produce thin-filmed coated appearances, which are flat and/or smooth satisfactorily, out of the high-viscosity paint "P" being coated on the automotive body 70.

Moreover, the coating nozzle 10 according to the thus constructed pre sent embodiment comprises the nozzle slit 15 whose slit opening area "s" is set up to be smaller than that of the conventional coating nozzles that Related Art Nos. 1 and 2 disclose under the condition that the slit opening "x" is 0.6 mm or more. Because of the nozzle slit 15 with a reduced slit opening area "s," a shear velocity "D" of the high-viscosity paint "P," which passes through the nozzle-slit outlet 15E, can satisfy such a requirement as from 5,000 to 20,000 $s^{-1}$ for a discharge rate "q" of the high-viscosity paint "P" that falls in a range of from 3,000 to 10,000 c.c./minute in a setting of the actual employment. Since the slit opening area "s" of the present coating nozzle 10 is made smaller, the present coating nozzle 10 has a slit width "y" that is smaller than that of the conventional coating nozzles that Related Art Nos. 1 and 2 disclose. That is, the slit opening area "s" is thus made smaller by making the slit width "y" smaller, instead of making the slit opening "x" smaller, in order to make a shear velocity "D" of the high-viscosity paint "P" greater. As a result, the clogged nozzle slit 15 is less likely to occur in the present coating nozzle 10 even when it is not possible to fully inhibit foreign materials from remaining Or residing within the high-viscosity paint "P."

In order to coat the high-viscosity paint "P" with such a smaller slit width "y" as described above so as to securely provide the high-viscosity paint "P" with a predetermined patterned width "A," it is necessary to diffuse the high-viscosity paint "P," which is discharged from the nozzle-slit outlet 15E, more in the width-wise direction than the conventional coating nozzles disclosed in the Related Art Nos. 1 and 2 diffuse the high-viscosity paint "P" in the width-wise direction. Hence, the coating nozzle 10 according to the present embodiment comprises the nozzle slit 15 whose slit angle "α" is set up at smaller than 45 degrees, and whose opening angle "β" is set up at larger than 90 degrees. The thus designed nozzle slit 15 can diffuse the high-viscosity paint "P," which is discharged from the nozzle-slit outlet 15E, more in the width-wise direction. It is difficult, however, to securely provide the high-viscosity paint "P" with a predetermined patterned width "A," while preventing the resulting pattern from cracking, by means of simply making the slit angle "α" smaller.

In view of the above, the coating nozzle 10 according to the present embodiment comprises the nozzle slit 15 including the nozzle-slit outlet 15E that has an arc configuration being set up so as to make a radius rate "b/a," a quotient that results from the division of the maximum radius "b" at the middle in the nozzle-slit outlet 15E by the minimum radius "a" at the opposite ends in the nozzle-slit opening 15E, greater than 1. That is, the nozzle-slit outlet 15E has an arc shape that elongates lopsidedly (or that is prolate) in a direction toward the middle. Note herein that the high-viscosity paint "P" is spouted substantially perpendicularly to the arc-shaped opening face of the nozzle-slit outlet 15E. Thus, due to the above-described reasons, the nozzle-slit outlet 15E having an arc shape, which elongates lopsidedly in a direction toward the middle, makes it possible to diffuse the high-viscosity paint "P," which is discharged from the nozzle-slit outlet 15E, more in the width-wise direction. Consequently, the nozzle slit 15 whose slit angle "α" is set up to be smaller at less than 45 degrees, as well as the nozzle-slit outlet 15E having an arc shape that elongates lopsidedly in a direction toward the middle produce the following synergetic effect: not only they enable the high-viscosity paint "P" to diffuse more in the width-wise direction while preventing the resulting pattern from cracking; but also they enable the high-viscosity paint "P" to securely provide the resultant pattern with a predetermined patterned width "A."

Moreover, the coating nozzle 10 according to the present embodiment comprises the nozzle slit 15 whose slit angle "α" is set up to fall in a range of from 35 to 42.5 degrees. The nozzle slit 15 effects the advantage of providing the resulting pattern with a predetermined patterned width "A" more highly reliably without ever letting the high-viscosity paint "P," which has been coated on the automotive body 70, suffer from cracks that occur in the resultant pattern. Note that, when the slit angle "α" is less than 35 degrees, the resulting pattern is likely to be cracked because the high-viscosity paint "P" has diffused in the width-wise direction too much. On the other hand, when the slit angle "α" exceeds 42.5 degrees, the resultant pattern is likely to be provided with a deficient patterned width "A" because the high-viscosity paint "P" has diffused in the width-wise direction too less.

In addition, the coating nozzle 10 according to the present embodiment comprises the nozzle slit 15 including the nozzle-slit outlet 15E in which a radius ratio "b"/"a", a ratio of the maximum radius "b" to the minimum ratio "a", is set up to fall in a range of from 1.03 to 1.11. The nozzle slit 15 effects the advantage of providing the resulting pattern with a predetermined patterned width "A" more highly reliably without ever letting the high-viscosity paint "P," which has been coated on the automotive body 70, suffer from cracks that occur in the resultant pattern. Note that, when the radius ratio "b/a" is less than 1.03, the resulting pattern is likely to be deficient in the patterned width "A" because the high-viscosity paint "P" has diffused in the width-wise direction too less. On the other hand, when the radius ratio "b/a" exceeds 1.11, the resultant pattern is likely to be cracked because the high-viscosity paint "P" has diffused in the width-wise direction too much.

It is appreciated from the above descriptions that the present embodiment can provide manufactures the coating nozzle 10 for high-viscosity paint "P" that can deliver the following advantages: making it possible to coat the high-viscosity paint "P" as thin films whose coated appearance is smooth and/or flat satisfactorily, and to coat it to a thin-filmed and proper patterned width "A"; as well as making the nozzle slit 15 less likely to be clogged.

The coating nozzle for high-viscosity paint according to the present invention is not limited at all to the above-described coating nozzle 10, one of the present embodiments. It is needless to say that, as far as not deviating from the gist of the present invention, the present invention can be executed in various modes being subjected to changes and modifications that one of ordinary skill in the art can carry out.

For example, the coating nozzle 10 according to the present embodiment comprises the nozzle slit 15 that converges from the nozzle-silt outlet 15E toward the nozzle-slit inlet 15G linearly. However, the coating nozzle 10 can comprise another nozzle slit that converges from the nozzle-slit outlet 15E toward the nozzle-slit inlet 15G in a curved manner. Note, however, that the above-described procedure for determining the imaginary apex "c" of an imaginary isosceles triangle shall be followed to determine an imaginary apex, which is needed to find a radius ratio in the present invention, even when the coating nozzle 10 comprises a nozzle slit that converges in a curved manner.

Moreover, the coating nozzle 10 according to the present embodiment comprises the nozzle slit 15 including the arc-shaped nozzle-slit outlet 15E that is formed as an elliptical arc. However, the arc-shaped nozzle-slit outlet 15E is not limited at all to those which are formed as an elliptical arc. The nozzle slit 15 can include another arc-shaped nozzle-slit outlet that is formed as a hyperbolic curve that elongates lopsidedly (or that is prolate) in a direction toward the middle, or that is formed as a protruded or convexed curve such as parabolas, for instance. Note, however, that the arc-shaped nozzle-slit outlet 15E cannot be formed as an arc of true circle, because it is one of the essential requirements that a radius ratio, a quotient that results from the division of a second radius by a first radius, is greater than 1.

Specific Embodiments

Descriptions will be made hereinafter on coating nozzles according to specific embodiments (i.e., Embodiment Nos. 1 through 5) of the present invention, and on coating nozzles according to comparative examples (i.e., Comparative Example Nos. 1 through 7). An experiment for coating high-viscosity paint was conducted using coating nozzles that took on a variety of configurations exhibiting various sorts of values distinctly in each of the slit angle "α," the radius ratio "b/a," and the slit opening area "s." Note that, in the respective coating nozzles, the slit opening "x" was set at 0.6 mm uniformly. Moreover, the coating experiment was carried out under the following experimental conditions:

Paint: High-viscosity Paint for Automobile;

Viscosity of Paint: 1.0 Pa·s at 20° C. (i.e., a value at 9,400 $s^{-1}$ shear velocity);

Coating Distance: 50 mm (i.e., the distance "B" shown in FIG. 2);

Temperature during Experiment: 25° C.;

Coating Speed: 1,000 mm/second; and

Discharge Rate: 3,000 c.c./minute, or 10,000 c.c./minute

Table 1 below gives in a list results of the experiment for coating high-viscosity paint. The coating experiment was conducted in the order of Comparative Example Nos. 1 through 7, and then in the order of Embodiment Nos. 1 through 5. Table 1 shows whether the coating nozzles according to Embodiment Nos. 1 through 5 and Comparative Example Nos. 1 through 7 were satisfactory (specified by the ○ mark) or unsatisfactory (specified by the x mark) as to the coated appearance (or flatness and/or smoothness), the patterned width "A," and the cracked pattern. Moreover, as an overall judgment, the coating nozzles were judged to be satisfactory (specified by the mark ○) when all of these tested items were satisfactory; whereas they were judged to be unsatisfactory (specified by the mark x) even when any one of the tested items was unsatisfactory. In addition, those with the satisfactory overall judgment were labeled an embodiment, respectively; whereas others with the unsatisfactory overall judgment were labeled a comparative example, respectively.

TABLE 1

| | | Comp. Ex. No. 1 | Comp. Ex. No. 2 | Comp. Ex. No. 3 | Comp. Ex. No. 4 | Comp. Ex. No. 5 | Comp. Ex. No. 6 |
|---|---|---|---|---|---|---|---|
| Slit Opening "x" (mm) | | 0.6 | 0.6 | 0.6 | 0.6 | 0.6 | 0.6 |
| Slit Angle "α" (deg.) | | 45 | 45 | 45 | 45 | 40 | 35 |
| Radius Ratio "b/a" | | 1.000 | 1.000 | 1.000 | 1.000 | 1.000 | 1.000 |
| Slit Opening Area "s" ($mm^2$) | | 21.6 | 19.0 | 15.1 | 10.8 | 11.7 | 12.6 |
| Discharge Rate "q" = 3,000 c.c./min. | Coated Appearance (Flatness and/or Smoothness) | ○ | x | ○ | ○ | ○ | ○ |
| | Patterned Width "A" (50mm or more) | ○ (57 mm) | ○ (54 mm) | x (47 mm) | x (43 mm) | x (47 mm) | ○ (52 mm) |
| | Cracked Pattern | ○ | ○ | ○ | ○ | ○ | ○ |
| Discharge Rate "q" = 10,000 c.c./min. | Coated Appearance (Flatness and/or Smoothness) | x | ○ | ○ | ○ | ○ | ○ |
| | Patterned Width "A" (100 mm or more) | ○ (107 mm) | ○ (100 mm) | x (89 mm) | x (83 mm) | x (93 mm) | x (98 mm) |
| | Cracked Pattern | ○ | ○ | ○ | ○ | ○ | ○ |
| Overall Judgment | | x | x | x | x | x | x |

| | | Comp. Ex. No. 7 | Embodiment No. 1 | Embodiment No. 2 | Embodiment No. 3 | Embodiment No. 4 | Embodiment No. 5 |
|---|---|---|---|---|---|---|---|
| Slit Opening "x" (mm) | | 0.6 | 0.6 | 0.6 | 0.6 | 0.6 | 0.6 |
| Slit Angle "α" (deg.) | | 30 | 42.5 | 40 | 40 | 40 | 35 |
| Radius Ratio "b/a" | | 1.000 | 1.075 | 1.091 | 1.036 | 1.108 | 1.108 |
| Slit Opening Area "s" ($mm^2$) | | 13.5 | 11.0 | 11.7 | 11.3 | 17.5 | 9.7 |
| Discharge Rate "q" = 3,000 c.c./min. | Coated Appearance (Flatness and/or Smoothness) | Not Evaluable | ○ | ○ | ○ | ○ | ○ |
| | Patterned Width "A" (50 mm or more) | Not Evaluable | ○ (55 mm) | ○ (58 mm) | ○ (52 mm) | ○ (60 mm) | ○ (51 mm) |
| | Cracked Pattern | x | ○ | ○ | ○ | ○ | ○ |
| Discharge Rate "q" = 10,000 c.c./min. | Coated Appearance (Flatness and/or Smoothness) | Not Evaluable | ○ | ○ | ○ | ○ | ○ |
| | Patterned Width "A" (100 mm or more) | Not Evaluable | ○ (110 mm) | ○ (115 mm) | ○ (104 mm) | ○ (121 mm) | ○ (103 mm) |
| | Cracked Pattern | x | ○ | ○ | ○ | ○ | ○ |
| Overall Judgment | | x | ○ | ○ | ○ | ○ | ○ |

Notes:
○ marks indicate "satisfactory," and x marks indicate "unsatisfactory."

As shown in Table 1, the coating nozzles according to Comparative Example Nos. 1 through 4 comprised nozzle slits being formed as configurations in which the slit opening "x," the slit angle "α," and the radius ratio "b/a" were set up equally at 0.6 mm, 45 degrees, and 1.000, respectively; but in which the slit opening area "s" was made smaller gradually in the order of Comparative Example Nos. 1, 2, 3 and 4. Due to such a setup, the resulting coated appearance got better gradually in terms of the flatness and/or smoothness because the shear velocity "D" became faster gradually. However, the slit width "y" was made smaller in order to make the slit opening area "s" smaller. As a result, the patterned width "A" became smaller gradually in the order of Comparative Example Nos. 1, 2, 3 and 4. Moreover, the coating nozzles according to Comparative Example Nos. 3 and 4 yielded poor results that they neither met the satisfactory value of 50 mm or more for the patterned width "A" at the discharge rate "q" of 3,000 c.c./minute nor the other satisfactory value of 100 mm or more for the patterned width "A" at the discharge rate "q" of 10,000 c.c./minute.

In light of the above, the coating nozzles according to Comparative Example Nos. 5 through 7 comprised nozzle slits having a slit angle "α" that was set up to be smaller than had the nozzle slit of the coating nozzle according to Comparative Example No. 4. The smaller slit angle "α" enabled the coating nozzles according to Comparative Example Nos. 5 through 7 to produce the patterned width "A" that was widened more than that the coating nozzle according to Comparative Example No. 4 produced, but there still arose cases where the resulting patterned width "A" did not meet the satisfactory value. Moreover, the coating nozzle according to Comparative Example No. 7 comprised a nozzle slit whose slit angle "α" was made smaller down to 30 degrees suffered from cracks in the resultant pattern. Note that the nozzle slits of the coating nozzles according to Comparative Example Nos. 5 through 7 had the enlarged slit width "y" in order to make the slit angle "α" smaller. Accordingly, the nozzle slits of the coating nozzles according to Comparative Example Nos. 5 through 7 had the slit opening area "s" that became larger gradually in the order of Comparative Example Nos. 5, 6 and 7. Consequently, although the coating nozzles according to Comparative Example Nos. 5 through 7 exhibited the shear velocity "D" that became slower gradually, they produced coated appearances whose flatness and/or smoothness were kept in a satisfactory condition, respectively.

Thus, none of the coating nozzles according to Comparative Example Nos. 1 through 7 were not rated to be satisfactory in terms of the overall judgment, although they comprised nozzle slits being formed as configurations in which the slit opening area "s," and the slit angle "α" were fluctuated while setting up the slit opening "x," and the radius ratio "b/a" equally at 0.6 mm, and 1.000, respectively. Hence, the inventors focused on the radius ratio "b/a," and manufactured the coating nozzles according to Embodiment No. 1 or later that comprised the nozzle silts including the arc-shaped nozzle-slit outlets that elongated lopsidedly (or that were prolate) in a direction toward the middle by setting up the radius ratio "b/a" at greater than 1.

The coating nozzle according to Embodiment No. 1 comprised the nozzle slit in which not only the slit angle "α" was set up at 42.5 degrees, being smaller than that was set up in the nozzle slit of the coating nozzle according to Comparative Example No. 4, but also the radius ratio "b/a" was set up at 1.075, being larger than that was set up in the nozzle slit of the coating nozzle according to Comparative Example No. 4. Note that the nozzle slits of the coating nozzles according to Embodiment No. 1 and Comparative Example No. 4 did not differ greatly in terms of the slit opening "s." Since the slit angle "α" was set up to be smaller at less than 45 degrees, and the arc-shaped nozzle-slit outlet elongated lopsidedly (or that prolate) in a direction toward the middle by setting up the radius ratio "b/a" at greater than 1, it was possible for the coating nozzle according to Embodiment No. 1 to produce the following synergetic effect: enabling the high-viscosity paint to secure a predetermined patterned width "A" by letting the high-viscosity paint diffuse more in the width-wise direction, while preventing the resulting pattern from cracking.

The coating nozzles according to Embodiment Nos. 2 through 5 comprised the nozzle slits in which not only the slit angle "α" was set up at 40 degrees or less, being smaller than that was set up in the nozzle slit of the coating nozzle according to Embodiment No. 1, but also the radius ratio "b/a" was set up to fall in range of from 1.036 to 1.108 and the slit opening area was set up to fall in a range of from 9.7 to 17.5 $mm^2$. The coating nozzles according to Embodiment Nos. 2 through 5 could securely provide the high-viscosity paint with a predetermined patterned width "A," while preventing the resulting pattern from cracking, in the same manner as the coating nozzle according to Embodiment No. 1 did.

The above-described experimental results were consulted in order to summarize some respective appropriate values for the slit opening "x," the slit angle "α," the radius ratio "b/a," and the slit opening area "s." Table 2 below gives the outcome. Moreover, Table 2 shows in a list faulty coatings and troubles that are concerned with cases where actual values of the slit opening "x," slit angle "α," radius ratio "b/a" and slit opening area "s" are less than the respective appropriate values, or the other cases where they exceed the respective appropriate values.

TABLE 2

| | | Feared Faulty Coatings and Troubles | |
|---|---|---|---|
| | Appropriate Value | When Being Less Than Appropriate Value | When Exceeding Appropriate Value |
| Slit Opening "x" in mm | No Less than 0.6 | Impaired Flatness/Smoothness, and Clogged Nozzle | None |
| Slit Angle "α" in deg. | From 35 to 42.5 | Cracked Pattern | Insufficient Patterned Width |
| Radius Ratio "b/a" | From 1.036 to 1.108 | Insufficient Patterned Width | Cracked Pattern |
| Slit Opening Area "s" in $mm^2$ | From 9.7 to 17.5 | Insufficient Patterned Width | Impaired Flatness/Smoothness |

Moreover, in the present specification, the term, "high-viscosity paint," refers to paints that can preferably exhibit a viscosity of from 0.1 to 5 Pa·s when being measured with a type-B viscometer at 20° C. Note that the lower-limit and upper-limit viscosities are values that are shown when a shear velocity is 9,400 $s^{-1}$. In addition, when the viscosity is less than 0.1 Pa·s, the lower-limit value, it is feared that the high-viscosity paint might possibly have spattered around because it is likely to diffuse to parts other than the coating is desired; whereas it is less likely to discharge the high-viscosity paint when the viscosity is more than 5 Pa·s, the upper-limit value.

Having now fully described the present invention, it will be apparent to one of ordinary skill in the art that many changes and modifications can be made thereto without departing from the spirit or scope of the present invention as set forth herein including the appended claims.

What is claimed is:

1. A coating nozzle that discharges high-viscosity paint, the coating nozzle comprising:

an introduction passage, an internal space, and a nozzle slit that communicate with each other and are disposed in this order so as to supply a high-viscosity paint to the internal space through the introduction passage, and so as to reserve the high-viscosity paint temporarily in the internal space, the high-viscosity paint being discharged from the nozzle slit while spreading radially, and then being blown onto an object to be coated;

the nozzle slit consisting of a nozzle-slit inlet on the internal space and a nozzle-slit outlet on a paint-discharge leading-end side, and being formed as a substantially-sector-shaped trapezoid that has a dimension expanding from the nozzle-slit inlet to the nozzle-slit outlet in a width-wise direction;

the nozzle-slit outlet being formed as an arc shape that has opposite ends and an imaginary chord connecting the opposite ends one another linearly;

the nozzle slit having a slit width that is made of the imaginary chord, and converging from a nozzle-slit outlet side to a nozzle-slit inlet side while heading toward an imaginary apex being held between two equilateral sides of an imaginary isosceles triangle whose base is the imaginary chord and whose base angles are a predetermined slit angle being in a range of from 35 to 42.5 degrees, the predetermined slit angle being formed by the imaginary chord and a lateral side of the substantially-sector-shaped trapezoid;

the arc-shaped nozzle-slit outlet exhibiting a radius ratio that is a value being obtained by dividing a second radius by a first radius, and which is in a range of from 1.03 to 1.11 when a first distance between the imaginary apex of the imaginary isosceles triangle and each end of the opposite ends of the imaginary chord is labeled the first radius and a second distance between the imaginary apex of the imaginary isosceles triangle and a central point in a width-wise direction of the arc-shaped nozzle-slit outlet is labeled the second radius;

the nozzle-slit outlet having, when being viewed on the paint-discharge leading-end side, a slit opening area configured to discharge the high-viscosity paint with a shear velocity, which passes through the nozzle-slit outlet, in a range of from 5,000 to 20,000 $s^{-1}$ for a discharge rate of from 3,000 to 10,000 c.c./minute of the high-viscosity paint; and the nozzle-slit inlet is arc-shaped and the nozzle slit tapers from narrow to wide in a direction away from the nozzle-slit inlet toward the nozzle-slit outlet in a width-wise direction.

2. The coating nozzle according to claim 1, wherein the high-viscosity paint exhibits a viscosity of from 0.1 to 5 Pa·s when being measured with a type-B viscometer at 20° C.

3. The coating nozzle according to claim 1 comprising the nozzle slit including the nozzle-slit outlet that is made up of a rectangular opening and two elongated trapezoidal openings being disposed on opposite sides of the rectangular opening, when being viewed in a front-view diagram.

4. The coating nozzle according to claim 1, wherein the slit opening area of the nozzle-slit outlet falls in a range of from 9.7 to 17.5 $mm^2$.

5. The coating nozzle according to claim 4, wherein the nozzle-slit outlet is at least 0.6 mm in a thickness-wise direction that crosses the width-wise direction perpendicularly.

6. The coating nozzle according to claim 5, wherein the slit opening accounts for approximately ⅓ or more of the slit width in the width-wise direction.

* * * * *